US006227511B1

(12) United States Patent
De Costa

(10) Patent No.: US 6,227,511 B1
(45) Date of Patent: May 8, 2001

(54) DETACHABLE BEVERAGE HOLDER

(76) Inventor: Sean M. De Costa, 1468 Caron Ct., Perris, CA (US) 92571

( * ) Notice: Subject to any disclaimer, the term of this patent is extended or adjusted under 35 U.S.C. 154(b) by 0 days.

(21) Appl. No.: 09/396,301

(22) Filed: Sep. 15, 1999

(51) Int. Cl.[7] ..... A47C 7/00
(52) U.S. Cl. ..... 248/311.2; 297/188.18
(58) Field of Search ..... 182/311.2; 297/188.14, 297/188.15, 188.18, 188.21

(56) References Cited

U.S. PATENT DOCUMENTS

| | | | | |
|---|---|---|---|---|
| 1,288,560 | * | 12/1918 | Gordon | 248/311.2 |
| 3,913,878 | * | 10/1975 | Wayne | 248/311.2 |
| 4,063,401 | * | 12/1977 | Wray | 248/311.2 |
| 4,262,962 | * | 4/1981 | Yust | 297/188.18 |
| 4,548,326 | * | 10/1985 | Danna . | |
| 5,044,577 | * | 9/1991 | Spearman | 248/311.2 |
| 5,295,650 | * | 3/1994 | Brandt | 248/311.2 |
| 5,690,036 | * | 11/1997 | Hasegawa | 248/311.2 |
| 5,853,158 | * | 12/1998 | Riggle | 248/311.2 |
| 6,010,104 | * | 1/2000 | Hanson | 248/311.2 |

FOREIGN PATENT DOCUMENTS

| | | | | |
|---|---|---|---|---|
| 75602 | * | 9/1949 | (NO) | 248/311.2 |

* cited by examiner

*Primary Examiner*—Alvin Chin-Shue
(74) *Attorney, Agent, or Firm*—Stetina Brunda Garred & Brucker

(57) ABSTRACT

A detachable beverage holder for use in holding a beverage in close proximity to a seat within a stadium or arena. The beverage holder includes an attachment mechanism for releasably fastening the device to a respective one of the arm-rests of a seat. An elongate arm member extends from the fastening member and includes a beverage holding member fastened thereto, via a hinge, at the distal-most end thereof. In use, the beverage holding member is free to rotate upwardly relative the arm member to enable spectators to freely move therearound. The arm member and beverage holder member may further include panels formed thereon for receiving advertisements or other commemorative memorabilia to enable the device to function as a souvenir. The detachable beverage holder may further be formed according to a sport's motif, as well as include a noise maker formed therein for use in cheering and applauding during a given event.

7 Claims, 1 Drawing Sheet

DETACHABLE BEVERAGE HOLDER

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The use of stadiums and arenas to hold concerts and sporting events is well-known. In this regard, such facilities have the ability to accommodate thousands of individuals to thus maximize live, first-hand attendance at a given event. To maximize space efficiency, the most common design for virtually all stadiums and arenas include rows of seats arranged in tiers or a terrace-like arrangement. Such seat members typically comprise a backrest member, a seat member, which typically is transitional between an open, operative configuration and a folded, non-operative configuration, and opposed arm rests members.

Hand-in-hand with the practice of staging events in concerts and arenas is the practice of operating concessions. Indeed, virtually every major event held in a stadium or arena deploys the use of multiple concession or refreshment stands whereby those attending the event can enjoy a meal and a beverage during the same. As is widely regarded, the food and beverage provided by such concession stands not only adds to the enjoyment of the event, but further can generate substantial revenue. This revenue can further be augmented to the extent souvenirs and other memorabilia commemorating such event are sold along with food and beverages.

Notwithstanding the complimentary nature concessions provide to stadium and arena events, substantial problems exist for spectators who wish to enjoy their food and beverage while sitting within the stadium or arena. In this regard, due to the limited space provided for a given seat in a row of seats, there is typically no place for a given spectator to put his or her food and beverage during the event. As such, most spectators are relegated to having to eat the food from their laps while placing their beverage on the ground. The latter practice is particularly problematic due to the great tendency to knock such beverages over, especially by being kicked aside due to the high degree of foot traffic moving in and around the rows of seats.

In fact, the only alternative to intermittently holding and placing such beverage on the ground is to permanently hold such beverage. Such practice, however, can cause great discomfort to the spectator and further, increases the likelihood that the spectator will spill such beverage on him or herself. This possibly is particularly likely during sporting events where it is commonplace to jump up and down from the seat to applaud for a team or watch a crucial moment in a sporting event, such as the last play of a football game. In fact, by virtue of having to hold a given beverage, a spectator is even precluded from clapping his on her hands to applaud a great play, thus detracting from the enjoyment of attending the event.

While it is known in the art to provide arm-rest members incorporated into the seat or chair members that have a pre-molded, generally-annular shape for receiving and holding a beverage, such beverage receiving apparatus has numerous drawbacks. Specifically, such beverage holders, which are formed as stationary items that protrude into the isle by which spectators access a given row of seats can get in the way of people moving thereabout. Additionally, due to the dissimilar size of most cups, cans and the like, such pre-formed angular beverage holders cannot accommodate any one specific type of cup or can. Furthermore, such beverage holders have a tendency to break over time and, because of the permanent nature by which the same are installed, require extensive time and labor to replace.

As such, there is a substantial need in the art for a beverage holder that can quickly and easily be utilized to provide individual spectators seated within a stadium or arena with means to hold a beverage while enjoying a given event. There is a further need in the art for a beverage holder that can be quickly and easily fastened to a seat situated within a stadium or arena that can be installed or withdrawn by a given spectator. Still further, there is a need in the art for a beverage holder that does not interfere with the ability for spectators to move about a given row of seats within a stadium or arena that may further serve to act as a souvenir item or as a means of advertisement.

BRIEF SUMMARY OF THE INVENTION

The present invention specifically addresses and alleviates the above-identified deficiencies in the art. In this regard, the present invention is directed to a detachable beverage holder for use in holding beverages for spectators attending an event at a stadium or arena. According to a preferred embodiment, the device comprises the combination of a fastening mechanism for gripping and firmly affixing the device to a dedicated seat, and more particularly, one of the respective arm-rests thereof. In a preferred embodiment, such fastening mechanism comprises a pair of opposed, downwardly extending arm members that are inwardly biased to compress about a portion of the armrest, such that the same forms a snap-fit thereabout. Alternatively, such fastening mechanism may comprise a vise member whereby a pair of opposed, downwardly extending arm members may be caused, via a screw, lever or cam grip about such arm rest. Extending from the fastening mechanism is an elongate arm portion having proximal and distal ends. Affixed to the distal-most end thereof, preferably via a hinge, is formed a beverage holder member. Preferably, the beverage holder member is formed to rotate upwardly relative the affixed arm and fastener mechanism such that the same is selectively transitionable between a first operative configuration whereby the beverage holder extends outwardly relative the arm portion fastening mechanism and may receive and hold a beverage therein, and a second non-operative configuration whereby the same is allowed to rotate upwardly relative the fastening mechanism and arm such that when not in use, the device does not interfere with the ability of individuals to move in and around a given isle or row of seats. The detachable beverage holder of the present invention may further include panel members formed thereon, particularly on the arm and beverage holder portions thereof for displaying advertisements or commemorative memorabilia related to a given event held within a stadium or arena. Moreover, the detachable beverage holder may be formed to have a decorative sport's motif and sold as a souvenir. The detachable beverage holder may further include a noise-making apparatus for use in cheering and applauding.

It is therefore an object of the present invention to provide a detachable beverage holder that may be easily and readily utilized as a means for holding a beverage in position in close proximity to a particular seat in a stadium or arena that can be detached therefrom and repeatedly reused.

Another object of the present invention is to provide a detachable beverage holder that enables a beverage to be securely held within close proximity to a given seat within a stadium or arena that enables a beverage to be securely held thereby while minimizing interference with spectators moving therearound, particularly when accessing a given seat within a row or isle of seats.

Another object of the present invention is to provide a detachable beverage holder that may be utilized for displaying advertisements or may function as a souvenir item to promote a given sports team or commemorate a special event.

Another object of the present invention is to provide a detachable beverage holder that may further be utilized as a novelty item for cheering or applauding at an event held within a stadium or arena.

Still further objects of the present invention are to provide a detachable beverage holder that is of simple construction, is inexpensive to manufacture, is simple to use and can be readily substituted for permanent beverage holding apparatus.

BRIEF DESCRIPTION OF THE SEVERAL VIEWS OF THE DRAWING

These, as well as other features of the present invention will become more apparent upon reference to the drawings wherein.

DETAILED DESCRIPTION OF THE INVENTION

The detailed description as set forth below in connection with the appended drawings is intended as a description of the presently preferred embodiments of the invention, and is not intended to represent the only form in which the present invention may be constructed or utilized. The description sets forth the functions and sequences of steps for constructing and operating the invention in connection with the illustrated embodiments. It is understood, however, that the same or equivalent functions and sequences may be accomplished by different embodiments and that they are also intended to be encompassed within the scope of this invention.

Figure 1:
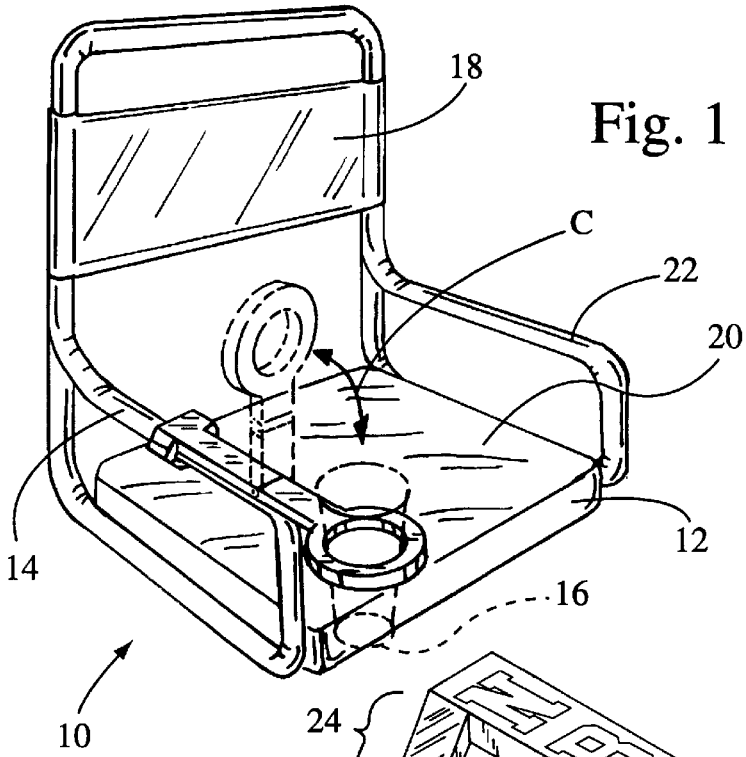
FIG. 1 is perspective view of a conventional seat with backrest and arm-rest members having a detachable beverage holder affixed thereto, the latter being constructed in accordance with a preferred embodiment of the present invention.

Referring now to the drawings, initially to FIG. 1, there is shown a detachable beverage holder 10 constructed in accordance to the preferred embodiment of the present invention. As illustrated, the device 10 is specifically designed and adapted to come affixed to a seat member 12, and more particularly, a respective arm-rest 14 thereof, to thus enable a beverage 16 (shown in phantom) to be held thereby in close proximity to an individual sitting within the seat 12.

In this regard, the device of the present invention is particularly well adapted for use with seats, such as 12, as may be situated in a stadium or arena. As is well-known, most stadiums and arenas are provided with tiered rows of seats that enable large quantities of spectators to attend concerts, sporting events and the like. Typically, such seats 12 are provided with a back-rest portion 18, a seating portion 20, and opposed arm-rests 14, 22. As will be recognized by those skilled in the art, the seat 12 depicted and various parts comprising the same are meant to depict a general embodiment of such seats and is not meant in anyway to limit the scope of the invention.

The device 10 is specifically adapted to position such beverage 16 such that the same extends forward relative the arm-rest 14 to provide easy access thereto. As is well-known, a spectator wishing to enjoy a beverage at a given event held within a stadium or arena, which are typically provided by a variety of concession stands operating during such event, requires the spectator to put the beverage on the ground or continuously hold the same until the beverage is finished. As a result, the beverages are frequently knocked over or kicked by passing spectators which can thus waste the beverage and create a substantial mess, often spilling on the shoes or clothes of other spectators. Advantageously, the beverage holder 10 of the present invention enables the beverage 16 to be held thereby, which thus eliminates the possibility that the same can be kicked or knocked over and further, frees up the hands of the spectator to enable such spectator to cheer, applaud or gesture as he or she may be inspired to do.

Figure 2:
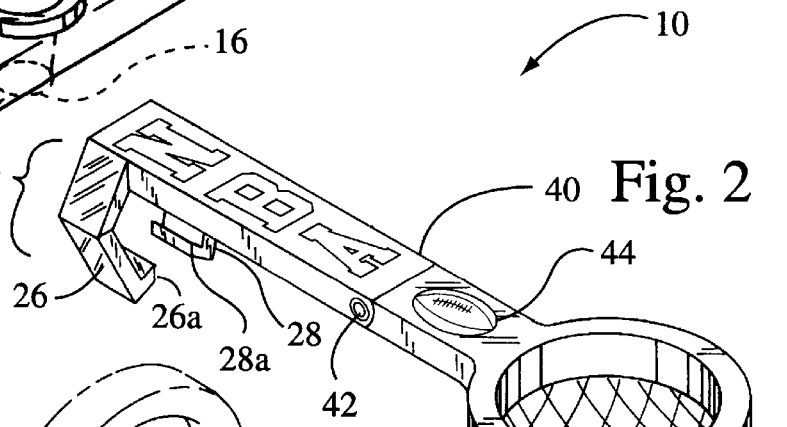
FIG. 2 is a perspective view of the detachable beverage holder of the present invention according to a preferred decorative embodiment.

Referring now to FIG. 2, there is perspectively illustrated the device 10 as constructed in accordance with a preferred decorative embodiment. To enable the device 10 to become secured to a seat, such as 12 in FIG. 1, and more particularly a dedicated arm-rest portion thereof, there is provided a fastener mechanism 24 formed upon the device 10. Preferably, such attachment mechanism comprises first and second downwardly-extending grip members or flanges 26, 28 that are designed to compressively fit and engage about an arm-rest portion of a seat. In this respect, each downwardly extending grip or flange 26, 28 is inwardly biased such that the same cooperate to produce a gripping effect about the arm-rest. To further enhance the ability of the device 10 to grip an arm-rest member, each downwardly extending grip or flange 26, 28 may be provided with a lip member 26*a*, 28*a* to thus provide for a more radial grasp about a given arm-rest member.

Figure 3:
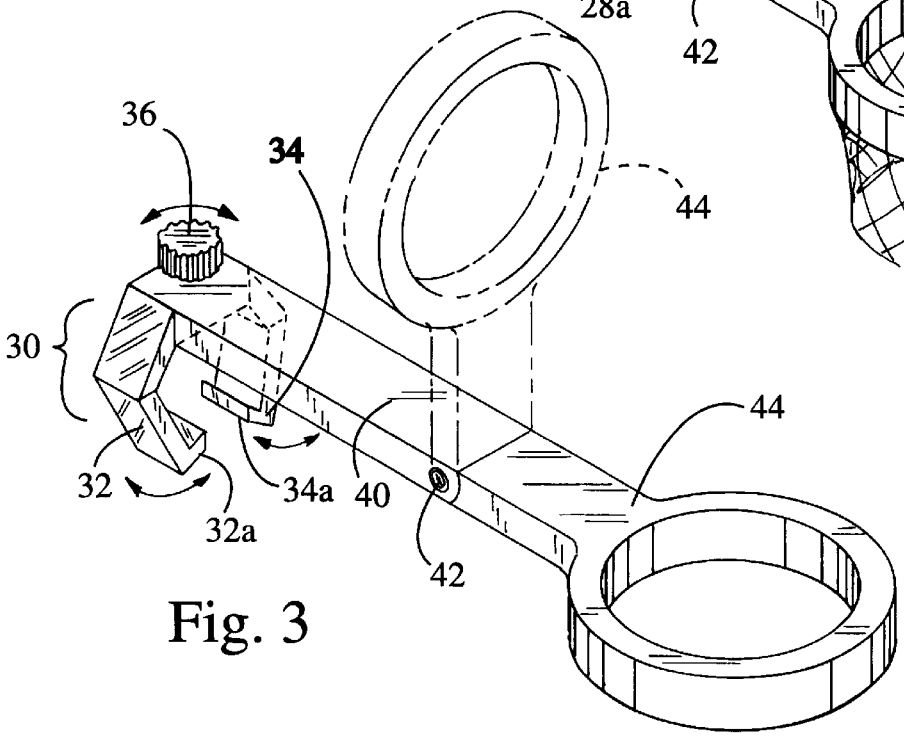
FIG. 3 is a perspective view of a detachable beverage holder of the present invention, the latter having a fastening mechanism formed thereon constructed in accordance with a second preferred embodiment.

In an alternative embodiment depicted in FIG. 3, such fastening mechanism 30 comprises a manually-operable vise member consisting of an opposed pair of grip members or flanges 32, 34, which may likewise incorporate ISP portions 32*a*, 34*a*, that cooperate to compress inwardly about the arm-rest member when the vise mechanism, which may preferably take the form of dial 36, as shown, is rotated in the direction indicated by the letter A as shown. As a consequence, such grip members or flanges 32, 34 will compress inwardly to thus form a tight fit about an arm-rest member. To release the device 10 from the armrest member, the vise mechanism or dial 36 may be rotated in the opposite direction. As will be appreciated by those skilled in the art, by providing for such vise fastening mechanism 30, the device 10 of the present invention will thus possess the ability to become affixed to any of a variety of arm-rest members which may have dissimilar shapes or configurations. In this regard, the grip or flange members 32, 34 will form a compressive fit against any surface disposed therebetween.

Extending forward or distally from the fastening mechanism of either embodiment depicted in FIGS. 2 or 3, is an elongate arm member 40. Preferably, such arm member 40 will be sized and configured to form a complimentary fit atop the arm-rest member to which the device 10 is attached. Preferably, the upper surface of such arm portion 40 will be adapted to display advertisements or some other ornate, decorative memorabilia, corresponding to the specific event held at the stadium or arena. Along these lines, it is contemplated that such portion of arm 40 may include the sport's logo of a particular team, as well as information regarding player statistics, season schedules, and the like. In this respect, it is contemplated that the device 10 of the present invention, in addition to being a fully functional beverage holder, may also function as a souvenir, which may thus increase further revenues for sport's teams, concert promoters and stadium/arena owners.

Formed upon the distal-most end of the arm member 40 is a beverage holding member 44. The beverage holder, as illustrated in FIGS. 1 through 3, preferably comprises an annular receiving apparatus into which a beverage may be held, as shown in phantom in FIG. 1. The beverage holding member 44 is connected to the distal end of arm member 40 via a hinge 42, which thus enables the beverage holding member 44 to rotate freely thereabout. In this regard, it is contemplated that the beverage holding member 44 will be designed to selectively transition between a first operative configuration whereby the same extends outwardly and is adapted to receive and securely hold a beverage. The beverage holding member 44 may alternatively rotate upwardly about hinge 42, in the direction indicated by the letter C depicted in FIG. 1, such that the same extends upwardly to assume the non-operative configuration. As will be appreciated by those skilled in the art, due to the capability of the beverage holding member 44 to extend upwardly to assume a non-operative configuration, the device 10 of the present invention may thus be manipulated to move away from the isle portion around such seat 12 to thus enable other spectators to move thereabout without affecting their ability to access other seats within a row of seats, as is typical for most stadiums and arenas.

As will be recognized by those skilled in the art, the device 10 of the present invention may be fabricated from any of a variety of materials, including metal, wood and/or plastic. With respect to the latter, it is believed that any of a variety of polymers can be utilized, as well as known manufacturing processes utilized therewith. For example, it is believed that the individual components of the device 10 of the present invention may be formed by injection molding techniques or other similar types of processes.

In addition to the foregoing, and as illustrated in FIG. 2, the detachable beverage holder 10 of the present invention may further be fabricated to have an ornate configuration including, but not limited to, a sport's motif. As illustrated in FIG. 2, the detachable beverage holder 10 of the present invention 10 is configured such that the beverage holding member 44 thereof is formed to resemble a conventional basketball hoop 52 with net 54 extending downwardly therefrom. As will be readily recognized by those skilled in the art, the beverage holder member may take a variety of configurations to identify with a particular sport. For example, a beverage holder member may be formed to resemble a football goal post, a tennis racket, a pair of crossed hockey sticks, a baseball glove, or a horseshoe, to name only a few possibilities.

To further enhance the ability of the detachable beverage holding device 10 of the present invention to function as a souvenir, it is further believed that a noise-making apparatus (not shown), may be incorporated into the device 10 to thus enable a spectator to more loudly cheer and applaud at a given event. According to a preferred embodiment, such noise-making apparatus may comprise a simple mechanical clicker or noise-maker that produces noise as the beverage holder member transitions between its operative and non-operative configurations, as depicted in FIGS. 1 and 3. In this regard, it is contemplated that a given spectator need only shake the device 10 back and forth such that the beverage holding member 44 transitions from its operative configuration, as shown in FIG. 3, to its non-operative configuration, as shown in phantom in FIG. 3, to thus produce the noise as he or she may be inspired to do. Although the movement of the beverage holding member 44 between its operative and inoperative configurations lends itself to mechanical noise-making apparatus, it is further contemplated that such device may include whistle or horn devices as may be desired.

Although the invention has been described herein with specific reference to a presently preferred embodiment thereof, it will be appreciated by those skilled in the art that various modifications, deletions, and alterations may be made to such preferred embodiment without departing from the spirit and scope of the invention. Accordingly, it is intended that all reasonably foreseeable additions, modifications, deletions and alterations be included within the scope of the invention as defined in the following claims.

What is claimed is:

1. A detachable beverage holder for selectively positioning a beverage within close proximity to a seat having armrests comprising:

a) a fastener mechanism adapted to releasably and selectively engage with one of said armrests of said seat;

b) an elongate arm portion extending from said fastener mechanism c) a beverage holding member pivotally connected to said elongate arm portion at a first end thereof about a horizontal pivot axis for receiving and holding said beverage therein, wherein said fastener mechanism comprises a vise at a second end of said elongate arm portion and comprising at least one leg fixed to one side of said elongate arm portion and extending downwardly therefrom, and another downwardly extending leg on another side of said elongate arm portion and in opposing relationship with said at least one leg, a rotatable dial on an upper surface of said elongate arm portion for compressively engaging said legs about a respective one of said armrests to extend the elongate arm portion in a generally parallel relationship with said one of the armrests.

2. The detachable beverage holder of claim 1 wherein said beverage holder member is selectively transitionable between:

(i) a first operative configuration whereby said beverage holding member may extends outwardly from said on of said armrests and forms a generally aligned relation therewith; and (ii) a non-operative configuration whereby said beverage holding member may extends upwardly from said on of said armrests and forms a generally perpendicular relation therewith.

3. The detachable beverage holder of claim 1 wherein said elongate arm portion includes a panel formed thereon for displaying an advertisement.

4. The detachable beverage holder of claim 1 wherein said elongate arm portion includes a logo formed thereon.

5. The detachable beverage holder of claim 1 wherein said elongate arm portion includes a panel formed thereon for displaying a decorative and ornamental indicia.

6. The detachable beverage holder of claim 1 wherein said beverage holding member comprises an annular ring for compressively engaging radially about a beverage container.

7. The detachable beverage holder of claim 6 wherein said annular ring is formed to have a configuration of a basketball hoop with net depending therefrom.

* * * * *